United States Patent [19]

Butterwick

[11] Patent Number: 4,521,713

[45] Date of Patent: Jun. 4, 1985

[54] SILICON TARGET SUPPORT ASSEMBLY FOR AN IMAGE SENSING DEVICE

[75] Inventor: Gilbert N. Butterwick, Leola, Pa.

[73] Assignee: RCA Corporation, Princeton, N.J.

[21] Appl. No.: 461,585

[22] Filed: Jan. 27, 1983

[51] Int. Cl.[3] ..... H01J 31/26; H01J 31/38

[52] U.S. Cl. ..... 313/378; 313/383

[58] Field of Search ..... 313/390, 281, 383, 384, 313/376, 378, 269

[56] References Cited

U.S. PATENT DOCUMENTS

| | | | |
|---|---|---|---|
| 2,493,539 | 1/1950 | Law | 250/164 |
| 2,582,843 | 1/1952 | Moore | 313/89 |
| 3,287,585 | 11/1966 | Randels | 313/89 |
| 3,303,373 | 2/1967 | Alting-Mees | 313/378 |
| 3,761,762 | 9/1973 | Henry et al. | 315/10 |
| 3,830,717 | 8/1974 | Singer et al. | 204/192 |
| 3,919,582 | 11/1975 | Ochs | 313/383 |
| 4,103,203 | 7/1978 | Ochs | 313/390 |
| 4,232,245 | 11/1980 | Savoye et al. | 313/367 |

*Primary Examiner*—Palmer Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An image sensing device includes a wafer of semiconductor material having a first surface and a second surface. The first surface has a central portion comprising a membrane, which is surrounded by a rim. The membrane is of lesser thickness than the rim. An improved support assembly for the device comprises a lower support member in contact with the rim portion of the second surface of the wafer near the periphery thereof, and an upper tensioning member having a target contact portion which forcibly abuts the rim portion of the first surface of the wafer adjacent to the membrane and urges the wafer against the lower support member thereby tensioning the membrane. Centering brackets center and secure the lower support member and the upper tensioning member within the device.

3 Claims, 2 Drawing Figures

SILICON TARGET SUPPORT ASSEMBLY FOR AN IMAGE SENSING DEVICE

BACKGROUND OF THE INVENTION

The invention relates to an imaging device incorporating a semiconductor wafer and more particularly to an improved silicon target support assembly for such a device.

Imaging devices such as silicon vidicons and silicon intensifier tubes employ sensing elements or targets consisting of single crystal silicon wafers. The operation of such silicon targets in these devices is well known in the art. Such an imaging device is described in U.S. Pat. No. 4,232,245 issued to E. D. Savoye et al., on Nov. 4, 1980 and incorporated by reference herein for the purpose of disclosure. The silicon target described in the Savoye et al. patent includes an input signal sensing surface and an oppositely disposed scan surface having a plurality of discrete PN junction storage diodes formed therein. It is common practice to thin the central portion of the input signal sensing surface of the target to a thickness of about 10 to 15 microns in order to obtain high resolution and to reduce lag. The thinned target is secured within the device either adjacent to the input faceplate in the case of a silicon vidicon, or in the target plane, spaced from the photocathode, in a silicon intensifier tube.

Applicant has discovered that thinning the central portion of the target causes the thinned membrane to wrinkle. In some targets, the wrinkles have a total excursion of about 0.25 mm which produce nonuniform variations in focus and shading in the output image. In applications where high resolution and good uniformity are required of the imaging device, it is necessary to minimize or eliminate target wrinkles.

U.S. Pat. No. 4,103,203 issued to S. A. Ochs on July 25, 1978 shows a thinned silicon target attached to an inner faceplate of a silicon vidicon by means of a transparent adhesive. While suitable for use in silicon vidicons where an input radiation species comprises photons, the transparent adhesive disclosed in the Ochs patent is unsuitable for use in silicon intensifier tubes of the type described in U.S. Pat. No. 3,761,762 issued to W. N. Henry et al., on Sept. 25, 1973 where photoelectrons from the photocathode of the intensifier portion of the device are incident on the silicon target. The adhesive and glass plate would prevent electrons from impinging on the target. A conventional target mounting or support structure adaptable for use in both silicon vidicons and silicon intensifier tubes is shown in U.S. Pat. No. 3,919,582 issued to S. A. Ochs on Nov. 11, 1975. This structure utilizes a formed support ring, a retainer ring and spring washer, all of equal diameters, to secure the silicon target near its periphery; however, the disclosed target mounting structure was proposed for a constant thickness silicon target without a thinned central portion. Such a mounting structure cannot remove target wrinkles.

SUMMARY OF THE INVENTION

An image sensing device includes a wafer of semiconductor material having a first surface and a second surface. The first surface has a central portion comprising a membrane. A rim surrounds the membrane which is of lesser thickness than the rim. An improved support means for the device comprises target retainer means having a lower support member in contact with the rim portion of the second surface of the wafer near the periphery thereof. The target retainer means further includes an upper tensioning member having a target contact portion which forcibly abuts the rim portion of the first surface of the wafer between the membrane and the periphery thereof thereby tensioning the membrane. Centering means centers and secures the target retainer means within the device.

DETAILED DESCRIPTION OF THE PREFERRED EMBODIMENTS

Figure 1:
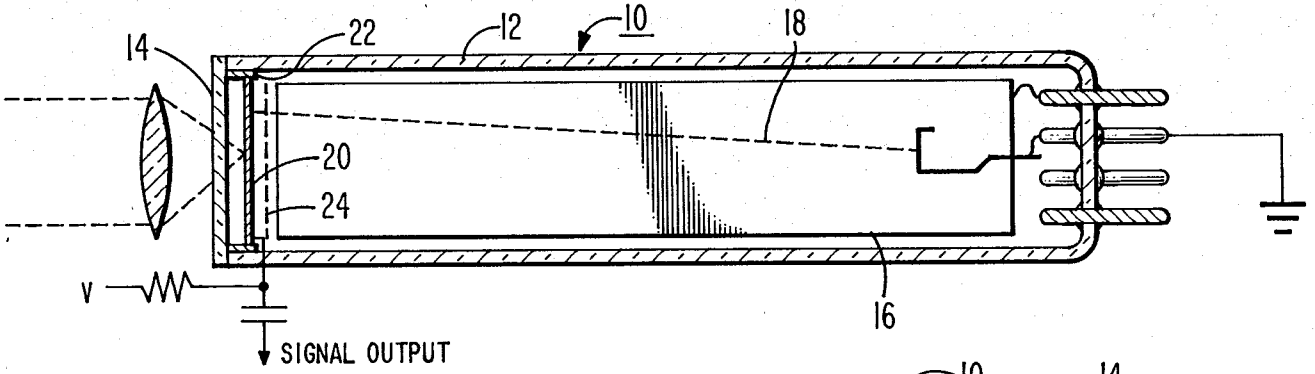
FIG. 1 is a longitudinal sectional view of a vidicon camera tube utilizing the present invention.

FIG. 1 shows a vidicon camera tube 10 having an evacuated glass envelope 12 with a transparent faceplate 14 at one end of the envelope 12 and including an electron gun assembly 16 inside the envelope 12 for forming a low velocity electron beam 18. A photon-excitable target 20 comprising a wafer of single crystal semiconductor material is mounted on a support assembly 22 and positioned adjacent to the inside surface of the faceplate 14 in a manner suitable for receiving a light input image signal. While the target 20 is described as being photon-excitable, it is known in the art that the target can also be excited by other radiant input species, for example, electrons from a photocathode. A mesh electrode 24 is spaced from the target 20 to decelerate the electron beam 18. Means (not shown) for magnetically focusing the beam 18 toward the target 20 and for causing the beam 18 to scan the surface of the target 20 may be disposed outside the envelope 12.

Figure 2:
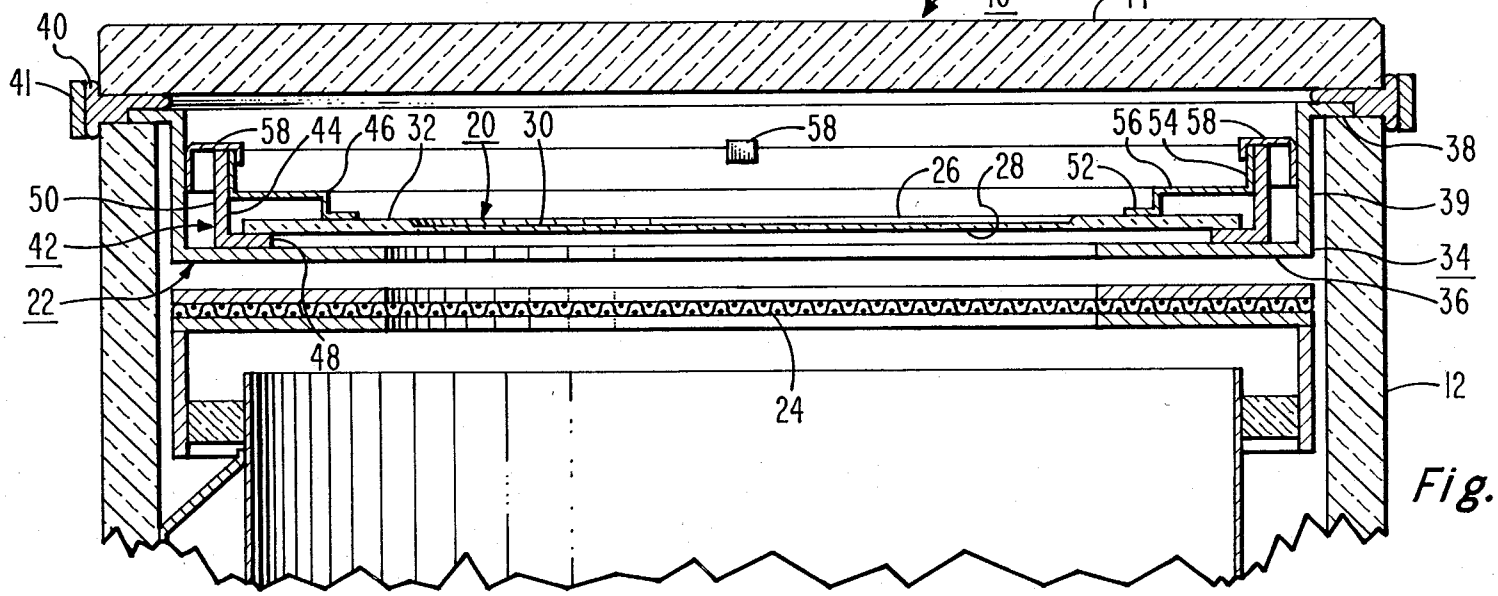
FIG. 2 is an enlarged sectional view of a portion of the tube of FIG. 1 showing the novel silicon target support assembly.

The target 20, shown in greater detail in FIG. 2, is a wafer of a single crystal of elemental silicon with first and second opposed major surfaces 26 and 28, respectively. The first surface 26 is the input signal sensing surface and the second surface 28 is the scan surface. The central portion of the first surface 26 is thinned or recessed by conventional methods to provide a membrane 30 having a thickness of about 10 to 15 microns and preferably 12 to 15 microns. A rim 32 having a thickness of about 0.127 mm surrounds the membrane 30. The second surface 28 of the target 20 which is scanned by the electron beam 18 includes a multiplicity of discrete photodiodes (not shown) which provide charge storage regions. The target 20 is conventional and is described in U.S. Pat. No. 4,232,245 referenced above.

The novel support assembly 22 comprises a target retainer support ring 34 which has an inwardly directed annular support flange 36 lying in a first plane and an outwardly extending contact flange 38 lying in a second plane substantially parallel to the first plane. The support flange 36 and the contact flange 38 are connected by a sidewall portion 39 extending therebetween. The outwardly extending contact flange 38 of the target retainer support ring 34 is supported by the endwall of the envelope 12 and is sealed between the envelope 12 and the faceplate 14 by a suitable conductive material 40 such as indium or aluminum. A conductive contact ring 41, e.g. of stainless steel, is disposed around the conductive material 40. Alternatively, if the envelope 12 is formed of a high alumina ceramic material rather than glass, the contact flange 38 may be brazed thereto by a method well known in the art. The target 20 is mounted within a target retainer 42 which includes an L-shaped lower support member 44 and an upper tensioning member 46 nested within the support member 44. The lower support member 44 includes an annular support ring portion 48 and a cylindrical skirt portion 50 extending substantially normal to the outer edge of the ring portion 48. The outside diameter of the lower support member 48 is less than the inside diameter of the sidewall portion 39 of the target retainer support ring 34. The target 20 is disposed within the lower support member 44 so that the periphery of the rim portion of the second or scan surface 28 is in contact with the support ring portion 48 of the lower support member. The upper tensioning member 46 includes a substantially flat annular contact portion 52 and a cylindrical wall portion 54 connected by a step like transition portion 56. With the upper tensioning member 46 nested within the lower support member 44, the annular contact portion 52 of the tensioning member 46 abuts the rim portion of the first surface 26 of the target 20 between the membrane 30 and the periphery of the rim portion. By way of example and not by limitation, a target retainer 42 has been constructed to support and tension a target 20 and to remove wrinkles from the membrane 30 thereof. The target 20 has a nominal outside diameter of 42.93 mm. The annular support ring portion 48 of the lower support ring member 44 which contacts the second surface 28 of the target 20 has an inside diameter of 40.64 mm thereby contacting the second surface of the target within about 1.15 mm of the periphery of the rim 32. The flat annular contact portion 52 of the upper tensioning member 46 contacts the first surface 26 of the target 20 across an annulus which extends from a diameter of about 35.56 mm to about 38.10 mm. Since the second surface 28 of the target 20 is supported near the periphery of the rim 32 (within about 1.15 mm from the outer edge of the target) and the first surface 26 of the target 20 is contacted substantially inward from the periphery (about 2.42 mm to 3.69 therefrom) and adjacent to the membrane 30, the target 20 can be placed in tension by exerting a slight downward force on the upper tensioning ring 46 to urge the target 20 against the annular support ring portion 48 of the lower support member 44. Applicant has found that by tensioning the target 20 as described herein, the wrinkles which occur from thinning the membrane 30 can be removed. Additionally, since the rim 32 of the target 20 is contacted on the first and second surfaces at different diameters as described herein, the resonant frequency of any target vibration is increased above that which occurs when equal diameter target support members secure the target near its periphery. The high frequency vibrations are quickly dampened by the different diameter support contacts. To maintain the target 20 under tension and to complete the target retainer 42, the cylindrical wall portion 54 of the upper tensioning member 46 and the cylindrical skirt portion 50 of the lower support member 44 are circumferentially welded together at a number of points. The target retainer 42 is placed on the support flange 36 of the retainer support ring 34 so that the second surface 28 of the target 20 faces the mesh electrode 24. A plurality of U-shaped centering brackets 58 are disposed over the upwardly directed, welded together portions 50 and 54 of the target retainer 42. The target retainer centering brackets 58 are fixedly attached, for example by welding, to the sidewall portion 39 of the support ring 34 to center and secure the target retainer 42 relative to the target retainer support ring 34.

While the novel support assembly 22 is described in the embodiment of a silicon target vidicon, it should be appreciated by those skilled in the art that the support assembly 22 can be adapted to tension and support silicon targets in silicon intensifier tubes, and thinned sensing elements including CCD's in devices such as intensified charged coupled image sensors described in U.S. Pat. No. 4,355,229 issued to H. S. Zimmerman et al., on Oct. 19, 1982.

What is claimed is:

1. In an image sensing device including a wafer of a semiconductor material having a first surface and a second surface, said first surface having a central portion comprising a membrane, said membrane being surrounded by a rim, said membrane being of lesser thickness than said rim, said second surface having at least one charge storage region, and support assembly means to hold said wafer within said device, the improvement wherein said support assembly means comprises:

target retainer means including a lower support member in contact with said rim portion of said second surface of said wafer near the periphery thereof, an upper tensioning member having a target contact portion which forcibly abuts said rim portion of said first surface of said wafer between said membrane and the periphery thereof thereby tensioning said membrane; and means for centering and securing said target retainer means within said device.

2. The image sensing device of claim 1 wherein said lower support member and said upper tension member are secured together.

3. In an image sensing device including an evacuated envelope having therein a wafer of a single crystal semiconductor material with a first surface and a second surface, said first surface having a recessed central portion comprising a membrane, said membrane being surrounded by a rim, said membrane being of lesser thickness than said rim, said second surface having a plurality of discrete charge storage regions, support means to hold said wafer within said device, an electron gun spaced from said wafer for generating an electron beam to scan said second surface of said wafer, and a target mesh disposed between said wafer and said electron gun, the improvement wherein said support means comprises:

a target retainer support ring having a support flange lying in a first plane and a contact flange lying in a second plane, said contact flange being supported by said envelope, said support flange and said contact flange being connected by a sidewall portion extending therebetween;

a lower support member having an annular support ring portion with a cylindrical skirt portion extending substantially normal to the outer edge of said support ring portion, said support ring portion being in contact with said rim portion of said second surface of said wafer near the periphery thereof; said lower support member being disposed upon said support flange of said target retainer support ring;

an upper tensioning member having an annular target contact portion and a cylindrical wall portion, said contact portion and said wall portion being connected by a step-shaped transition portion, said wall portion being in contact with said skirt portion of said lower support member and being secured thereto, said contact portion forcibly abutting said rim portion of said first surface of said wafer adjacent to said membrane and urging said wafer against said annular support ring portion of said lower support member thereby tensioning said membrane; and a plurality of target retainer centering brackets for centering and securing said lower suppor member and said upper tensioning member relative to said target retainer support ring.

* * * * *